United States Patent [19]

Fugett

[11] 4,163,436

[45] Aug. 7, 1979

[54] GASOLINE MISER

[76] Inventor: Albert Fugett, Rte. 2, Box 221, Gaston, Ind. 47342

[21] Appl. No.: 800,188

[22] Filed: May 25, 1977

[51] Int. Cl.[2] ..... F02M 29/00

[52] U.S. Cl. ..... 123/141; 261/78 R; 48/180 B

[58] Field of Search ..... 123/141; 261/78 R, 79 R; 48/180 R, 180 M, 180 B

[56] References Cited

U.S. PATENT DOCUMENTS

| | | | |
|---|---|---|---|
| 942,503 | 12/1909 | Jacobs | 123/141 |
| 2,152,206 | 3/1939 | Neal | 123/141 |
| 2,657,123 | 10/1953 | Goldman | 123/141 X |
| 2,659,667 | 11/1953 | Boodet | 123/141 X |
| 2,701,557 | 2/1955 | Ramey | 123/141 |
| 3,544,290 | 12/1970 | Larson et al. | 123/141 X |

*Primary Examiner*—Ira S. Lazarus
*Attorney, Agent, or Firm*—James D. Haynes

[57] ABSTRACT

A screen and a stationary screw propeller are arranged in round chambers between the carburetor and intake manifold of an internal combustion engine of an automobile, for example, to substantially increase the efficiency and gasoline mileage thereof.

9 Claims, 2 Drawing Figures

GASOLINE MISER

BACKGROUND OF THE INVENTION

Heaters and vaporizers have been proposed for use in carburetors to improve the efficiency thereof, but most are complicated, and require special tools to make, as well as to install. Also, such proposals fail, due to the nature of the apparatus causing the formation of solids on the internal equipment that is exposed to heat and the gasoline-air mixture.

The main object of this invention is to provide a gasoline miser that is simple and inexpensive to make and install in existing internal combustion engines, as well as one that is self-cleaning and not subject to fouling in use.

SUMMARY OF THE INVENTION

A heavy metal fine screen and a stationary screw propeller are provided in round holes between the carburetor outlet and intake manifold of an auto engine to first break up into super fine particles, the air-gasoline mixture leaving the carburetor, and then swirl the resulting super fine air borne particles of gasoline downwardly and outwardly into the intake manifold inlet chamber of the engine. Thus, the gasoline is fully vaporized and mixed in the air stream, providing a mixture that is highly combustible and efficient in the engine. The engine life is increased, mileage is increased, and pollution decreased.

DETAILED DESCRIPTION OF THE INVENTION

Figure 1:
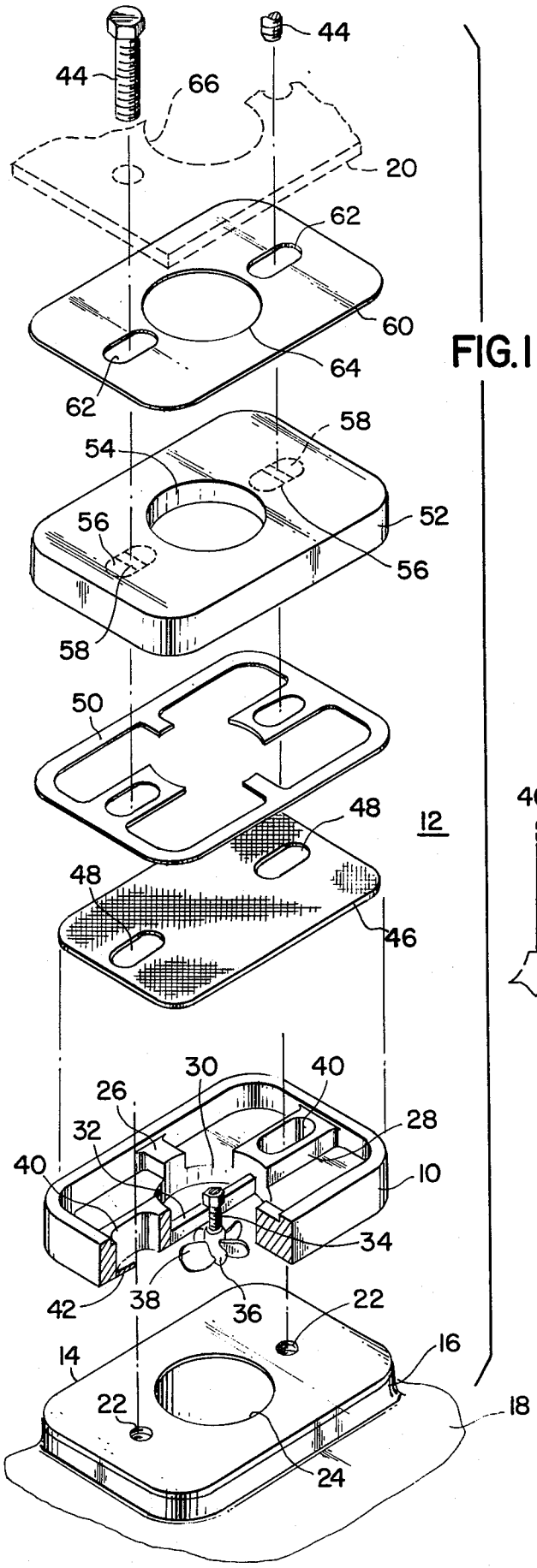
FIG. 1 is an exploded view in perspective of a gasoline miser embodying the invention, with parts shown of a carburetor and intake manifold.

As shown in the drawings, a bottom section 10 of the miser 12 is mounted on a gasket 14 on the top of intake manifold 16 of an internal combustion engine 18 having a carburetor 20. The manifold 16 is provided with threaded sockets 22, 22 on either side of a central inlet chamber 24, leading to the inside of the manifold 18. The bottom section 10 is hollow except for ribs 26 and 28 which support a cylinder 30 having a cross support 32 for a bolt 34 from which is suspended a stationary screw propeller 36 having a plurality of blades 38, in the round chamber 24. The ribs 28 are provided with slots 40 having knockout tabs 42 in one side of the bottom thereof for aid in aligning the various gaskets with screw bolts 44, 44 which hold the parts together.

Figure 2:
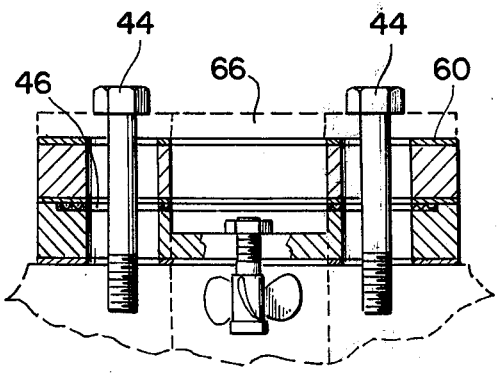
FIG. 2 is a view in vertical cross-section of the miser in place.

A heavy metal fine screen 46 is mounted on the bottom section 10, having slots 48, 48 matching slots 40, 40 in the section 10. A rim gasket 50 is disposed between the screen 46 and a top section 52 of substantial thickness having a central hole 54 and slots 56, 56 provided with upper knockout tabs 58. A gasket 60 having slots 62, 62 and a central hole 64, is clamped between the bottom of carburetor 20 and the top of section 52, so that the outlet 66 of the carburetor 20 matches the holes 64 and 54 of the gasket 60 and top section 52. The parts of the miser 12 shown in FIG. 1, are clamped together, FIG. 2, between the bottom of carburetor 20 and top of intake manifold 16 by the screw bolts 44, 44 which are threaded to the sockets 22, 22.

In operation, the fine screen 46 breaks up into super fine particles, the gasoline in the air-gasoline fuel mixture leaving carburetor 20 outlet 66, and then is swirled outwardly into the manifold inlet chamber 24, by the stationary screw propeller 36 blades 38, completing vaporization of the gasoline in such fuel mixture.

Greater combustion in the engine 18, of the fuel mixture is thus achieved, along with much better mileage, as much as 75%; less pollution; and an increase in the engine life. The device is easy to install, since it fits between the carburetor and manifold; and is safe in use. While the invention is shown with a single barrel type of carburetor, it can be adapted for 2 and 4 barrel carburetors as well.

The screen is composed of a bronze wire mesh, but may be made of metal wire coated or plated with a catalytic agent such as platinum. Where the case warrants, platinum itself may be used.

I claim:

1. A gasoline miser for use between the carburetor and the intake manifold of a gasoline engine, said gasoline miser comprising:

a substantially hollow top section;

a substantially hollow bottom section;

means for breaking liquid gas into superfine particles being disposed between said top section and said bottom section and comprising a screen means, said screen means having a planar cross-sectional area conformal with said cross-sectional area of said chamber whereby the said planar cross-sectional area of said screen through which said liquid gas passes is substantially greater than the outlet of said carburetor; and vaporizing means, said top and bottom sections having central holes on the exterior thereof of substantially the same size as the outlet of the carburetor and the inlet of the intake manifold, said top and bottom sections forming a chamber therebetween, said chamber having a cross-sectional area substantially greater than the cross-sectional area of said central holes.

2. A gasoline miser as set forth in claim 1 wherein said vaporizing means comprises a screw propellar disposed external to said chamber and within said intake manifold whereby said gas particles are directed against the sides of said intake manifold to cause vaporization thereof.

3. A gasoline miser as set forth in claim 2 wherein said propellar is stationary.

4. A gasoline miser for use between the carburetor and the intake manifold of a gasoline engine, said gasoline miser comprising:

a substantially hollow top section;

a substantially hollow bottom section;

means for breaking liquid gas into superfine particles being dispsed between said top section and said bottom section and comprising a screen means, said screen means having a planar cross-sectional area conformal with said cross-sectional area of said chamber whereby the said planar cross-sectional area of said screen through which said liquid gas passes is substantially greater than the inlet of said intake manifold; and vaporizing means, said top and bottom sections having central holes on the exterior thereof of substantially the same size as the outlet of the carburetor and the inlet of the intake manifold, said top and bottom sections forming a chamber therebetween, said chamber having a cross-sectional area substantially greater than the cross-sectional area of said central holes.

5. A gasoline miser as set forth in claim 4 wherein said vaporizing means comprises a screw propellar disposed external to said chamber and within said intake manifold whereby said gas particles are directed against the sides of said intake manifold to cause vaporization thereof.

6. A gasoline miser as set forth in claim 5 wherein said propellar is stationary.

7. In a gasoline engine having a chamber disposed between a carburetor and an intake manifold, said chamber having a screen therein and an agitator means therebelow, the method of vaporizing gas comprising the steps of:

passing the gasoline laden air leaving the carburetor into an expanding chamber having a width perpendicular to the direction of air flow substantially greater than the width of the inlet to the intake manifold;

passing the gasoline laden air from said chamber into a smaller passageway than that of said chamber;

directing the gasoline laden air from said smaller passageway over agitating means to thus subject said air to extreme turbulence; and directing the gasoline laden air against the interior walls of said intake manifold to thus vaporize the gas particles in said gasoline laden air.

8. The method of claim 7 wherein the step of directing the gasoline laden air over agitating means comprises the step of directing the gasoline laden air over a stationary propellar.

9. The method of claim 7 wherein the step of directing the gasoline laden air over agitating means comprises the step of directing the gasoline laden air over a stationary propellar disposed within said intake manifold.

* * * * *